US011820647B1

(12) United States Patent
Everett

(10) Patent No.: US 11,820,647 B1
(45) Date of Patent: Nov. 21, 2023

(54) SADDLE HORN ROPING TAPE

(71) Applicant: James Darrell Everett, Missouri City, TX (US)

(72) Inventor: James Darrell Everett, Missouri City, TX (US)

(73) Assignee: CROSSFIRE EQUINE PRODUCTS, INC., Sugar Land, TX (US)

( * ) Notice: Subject to any disclaimer, the term of this patent is extended or adjusted under 35 U.S.C. 154(b) by 0 days.

(21) Appl. No.: 17/583,006

(22) Filed: Jan. 24, 2022

Related U.S. Application Data

(60) Provisional application No. 63/141,770, filed on Jan. 26, 2021.

(51) Int. Cl.
*B68C 1/02* (2006.01)

(52) U.S. Cl.
CPC ..... *B68C 1/02* (2013.01)

(58) Field of Classification Search
CPC ..... B68C 1/02
See application file for complete search history.

(56) References Cited

U.S. PATENT DOCUMENTS

| | | | | |
|---|---|---|---|---|
| 3,707,827 | A * | 1/1973 | Strang | B68C 1/20 54/46 |
| 7,992,366 | B2 | 8/2011 | McCarthy | |
| 8,037,665 | B2 | 10/2011 | McCarthy | |
| 2017/0203327 | A1* | 7/2017 | Hawkins | B05D 1/02 |

* cited by examiner

*Primary Examiner* — Joshua J Michener
*Assistant Examiner* — Henry Hooper Mudd
(74) *Attorney, Agent, or Firm* — Plager Schack LLP; Mark H. Plager; Kara K. Verryt

(57) ABSTRACT

A saddle horn roping tape to assist a roper during dallying may include an elongate tape body; a slit opening extending through the elongate tape body proximate to a first end thereof; a plurality of raised ribs extending upward from a top surface of the elongate tape body proximate to a second end thereof; and an adhesive applied to a bottom surface of the second end of the elongate tape body. Each of the plurality of raised ribs may be positioned at an angle with respect to a length of the elongate tape body, wherein each of the plurality of raised ribs may have a rounded cross-section.

10 Claims, 3 Drawing Sheets

SADDLE HORN ROPING TAPE

RELATED APPLICATION

This application claims priority to provisional patent application U.S. Ser. No. 63/141,770 filed on Jan. 26, 2021, the entire contents of which is herein incorporated by reference.

BACKGROUND

The embodiments described herein relate generally to equine accessories and, more particularly, to a device designed to be applied to a saddle horn for benefits during roping.

Dallying or wrapping a rope around a saddle horn is part of the act of roping. Existing devices that are applied to the saddle horn to assist in dallying or wrapping the rope around the saddle horn include circular bands or strips of rubber that are smooth and allow for slippage. They are difficult to apply, unsightly, and can cause injury to a roper's hand. Moreover, the existing devices can transfer material to the rope during use, causing both the device and the rope to wear at a much faster rate. This can cause the devices to become worn and slick, creating a safety hazard known as rope slippage. Rope slippage can pull a roper's fingers into a position between the rope and the saddle horn, causing injury to or even amputation of the finger.

Therefore, what is needed is a device that can be easily and efficiently applied to a saddle horn for dallying, wherein the device stays put during use and increases resistance between the device and the rope to help prevent or reduce slippage and run.

SUMMARY

Some embodiments of the present disclosure include saddle horn roping tape to assist a roper during dallying may include an elongate tape body; a slit opening extending through the elongate tape body proximate to a first end thereof; a plurality of raised ribs extending upward from a top surface of the elongate tape body proximate to a second end thereof; and an adhesive applied to a bottom surface of the second end of the elongate tape body. Each of the plurality of raised ribs may be positioned at an angle with respect to a length of the elongate tape body, wherein each of the plurality of raised ribs may have a rounded cross-section.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to attach to a saddle horn for dallying and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-7, some embodiments of the present disclosure include a saddle horn roping tape to assist a roper during dallying, the saddle horn roping tape comprising an elongate tape body 10, a slit opening 12 extending through the elongate tape body 10 proximate to a first end thereof, a plurality of raised ribs 14 extending upward from a top surface of the elongate tape body 10 proximate to a second end thereof; and adhesive 18 applied to a bottom surface of the second end of the elongate tape body 10.

Figure 1:
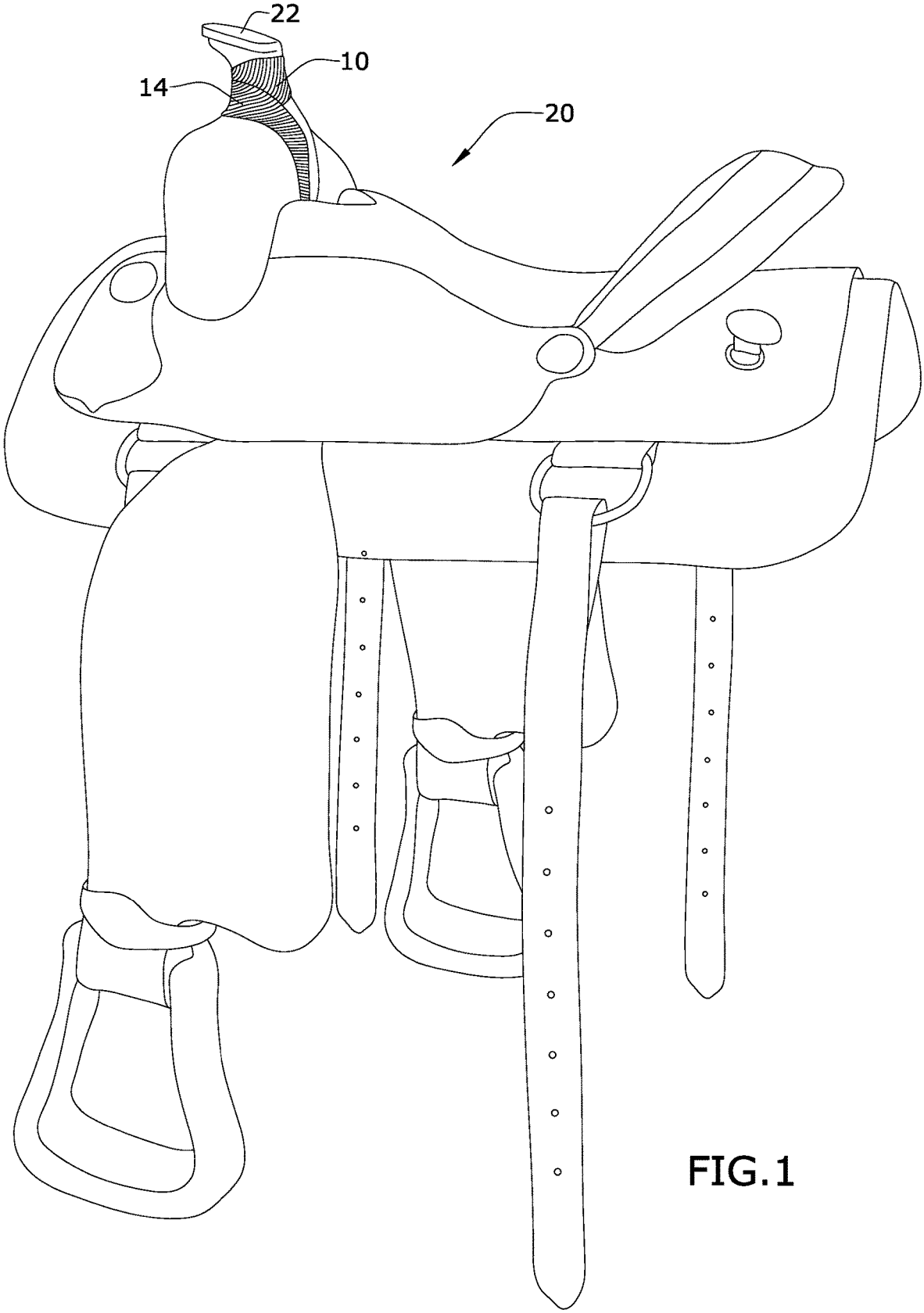
FIG. 1 is a perspective view of one embodiment of the present disclosure, shown in use.
Figure 2:
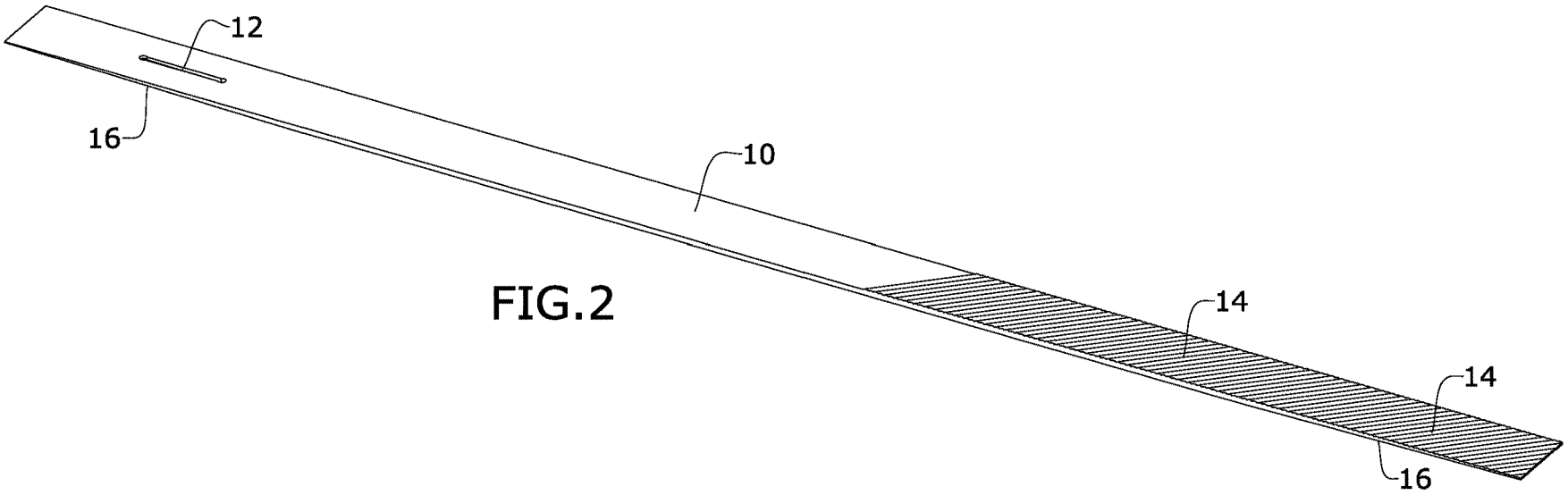
FIG. 2 is a perspective view of one embodiment of the present disclosure.
Figure 3:
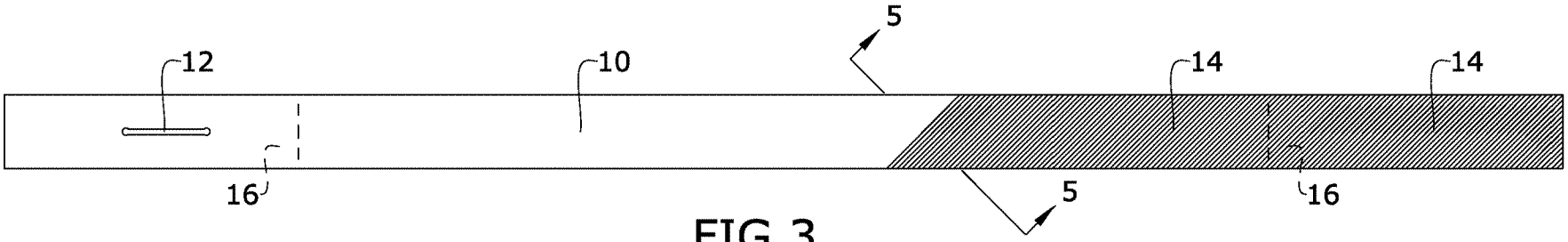
FIG. 3 is a top view of one embodiment of the present disclosure.
Figure 4:
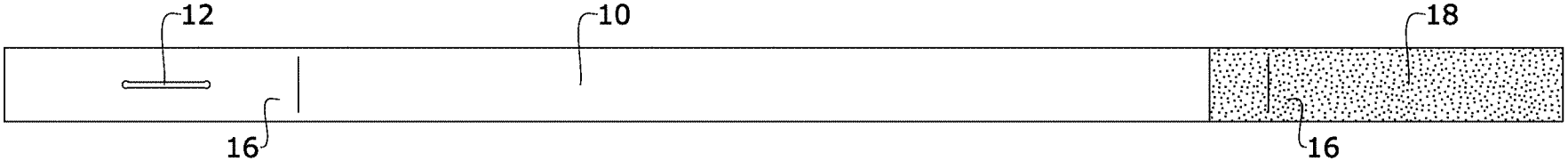
FIG. 4 is a bottom view of one embodiment of the present disclosure.
Figure 7:
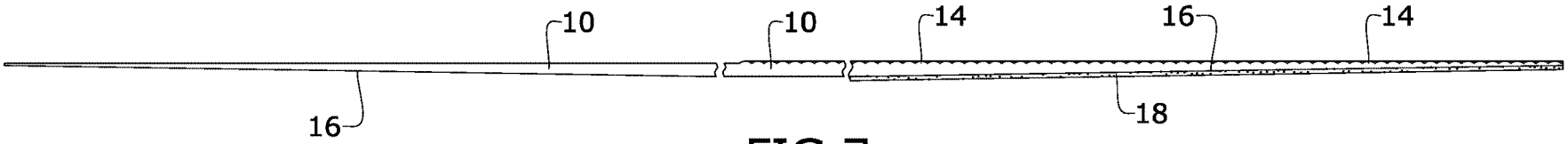
FIG. 7 is an enlarged front view of one embodiment of the present disclosure.

As shown in the Figures, the elongate tape body 10 may be substantially rectangular with a uniform width and a thickness that tapers toward each end. Thus, as shown in FIGS. 2 and 7, a thickness (i.e., a distance between the top surface and the bottom surface) of the elongate tape body 10 may be greatest at a central region of the elongate tape body 10 and each of the first end and the second end may comprise a tapered end 16, wherein the smallest thickness is at the extreme ends of the elongate tape body 10.

Exemplary dimensions for the elongate tape body 10 include a length of from about 45 to about 60 inches, a width of about 2 to 3 inches, and a thickness tapering from about ⅛ inch to about 1/32 inch. In a particular embodiment, the elongate tape body 10 may have a length of about 53 inches and a width of about 2.5 inches, wherein the 10 inches closest to each of the first end and the second end may have a thickness that tapers down to the smallest thickness of about 0.03125 inches.

In embodiments, the slit opening 12 may be positioned proximate to the first end of the elongate tape body 10. As shown in the Figures, the slit opening 12 may be elongate and have a size sufficient for the second end of the elongate tape body 10 to pass therethrough. More specifically, the slit opening 12 may be substantially rectangular shape with rounded ends, wherein a first end of the slit opening 12 is about 4 inches from the first end of the elongate tape body 10. The slit opening 12 may have dimensions slightly larger than a width and thickness of the elongate tape body 10. For example, the slit opening 12 may be about 3 inches long and about 0.1875 inches wide.

Figure 5:
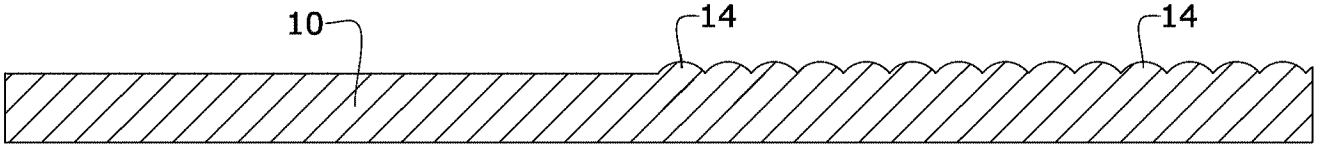
FIG. 5 is a section view of one embodiment of the present disclosure, taken along line 5-5 in FIG. 3.
Figure 6:
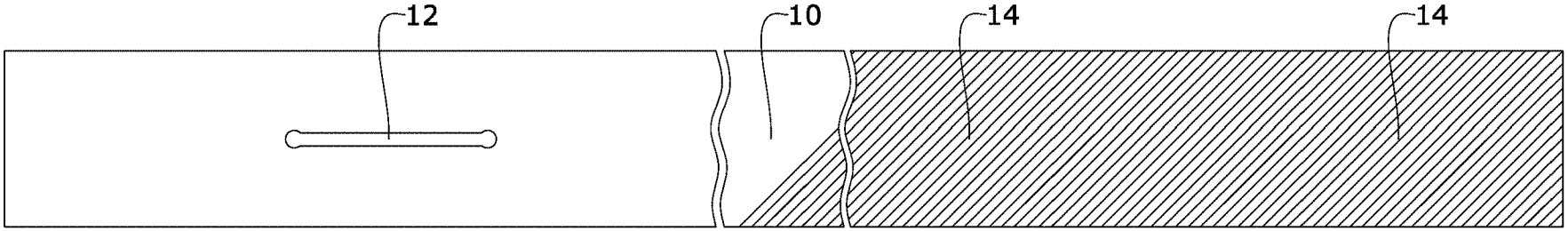
FIG. 6 is an enlarged top view of one embodiment of the present disclosure.

As described above, the second end of the elongate tape body 10 may comprise a plurality of raised ribs 14 extending from an upper surface thereof. As shown in the Figures, the plurality of raised ribs 14 may be angled with respect to a length of the elongate tape body 10. For example, each rib of the plurality of raised ribs 14 may be positioned at an angle of about 45° with respect to a length of the elongate tape body 10. As shown in FIG. 5, each of the raised ribs 14 may comprise a rounded rib, such as a rib with a semi-circular cross section. In a particular embodiment, each rib may have a protrusion height of about 0.03125 inches and a protrusion width of about 0.125 inches. The plurality of raised ribs 14 may cover a length of about 15 to about 25 inches, such as about 23 inches, from the second end of the elongate tape body 10 toward a central portion of the elongate tape body 10.

As mentioned previously, the elongate tape body 10 may have an adhesive 18 applied to a bottom surface of the second end thereof. In some embodiments, the adhesive 18 may cover about 12 inches of the second end of the elongate tape body 10. Prior to use, the adhesive 18 may have a peel-away paper (not shown) removably attached thereto, with a 402 solvent based, single application adhesive to bond the final 2" of rubber in a manner that prevents the tape from unraveling from the saddle horn.

While exemplary dimensions of the elongate tape body 10 are disclosed above, it is understood that these dimensions may vary. However, the overall structure may remain the same. The elongate tape body 10 may be made of a flexible, yet durable material. For example, the elongate tape body 10 may be made of a vulcanized rubber that is soft enough to provide cushion to the rope.

To use the saddle horn roping tape of the present disclosure, a user may apply the tape to a saddle horn 22 on a saddle 20. More specifically, the slit may provide a method to begin application of the elongate tape body 10 by holding the elongate tape body 10 in place at the saddle horn 22. The elongate tape body 10 may then be fed under the gullet of the saddle 20 and pulled through the front of the saddle 20 where the elongate tape body 10 may be slightly stretched for an accurate fit to the saddle horn 22 in a plurality, such as three, continuous clockwise wraps. The adhesive 18 may provide for a way to anchor the elongate tape body 10 to itself for a firm, non-movable hold on the saddle horn 22 once in place. This also allows for the plurality of raised ribs 14 to be exposed on the outer layer of the elongate tape body 10, wherein the raised ribs 14 act as the first point of contact for a rope when applied to the saddle horn 22, enabling the rope to bite into the material and not slip or move, thereby affixing an object being roped or dragged without damage to the material or the rope and without injuring the roper's fingers.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A saddle horn roping tape to assist a roper during dallying, the saddle horn roping tape comprising:
- an elongate tape body;
- a slit opening extending through the elongate tape body proximate to a first end thereof;
- a plurality of raised ribs extending upward from a top surface of the elongate tape body proximate to a second end thereof; and
- an adhesive applied to a bottom surface of the second end of the elongate tape body,
- wherein:
  - each rib of the plurality of raised ribs is elongate and extends across the elongate tape body from a first elongate edge thereof to a second elongate edge thereof, wherein the first elongate edge is opposite the second elongate edge; and
  - each rib of the plurality of raised ribs is positioned at an angle of about 45° with respect to a length of the elongate body.

2. The saddle horn roping tape of claim 1, wherein the elongate tape body is rectangular with a uniform width and a thickness that tapers toward each of the first end and the second end.

3. The saddle horn roping tape of claim 2, wherein the elongate tape body has a centrally located thickness of about ⅛ of an inch and a thickness of about 1/32 of an inch at each of the first end and the second end.

4. The saddle horn roping tape of claim 1, wherein each of the plurality of raised ribs has a rounded cross-section.

5. The saddle horn roping tape of claim 1, wherein the elongate body has a length of from about 45 to about 55 inches and a width of about 2 to about 3 inches.

6. The saddle horn roping tape of claim 1, wherein the slit opening is an elongate rectangle with rounded ends.

7. The saddle horn roping tape of claim 1, wherein the slit opening has a length longer than a width of the elongate tape body.

8. The saddle horn roping tape of claim 1, wherein the elongate tape body comprises vulcanized rubber.

9. The saddle horn roping tape of claim 1, wherein:
- the elongate tape body has a first end and a second end;
- a first portion of the elongate tape body is proximate to the first end and is free of raised ribs;
- a second portion of the elongate tape body is proximate to the second end; and
- the plurality of raised ribs are positioned on the second portion of the elongate tape body.

10. The saddle horn roping tape of claim 1, wherein:
- the elongate tape body has a length; and
- the plurality of raised ribs cover about 25% to about 55% of the length of the elongate tape body.

* * * * *